United States Patent [19]

Humbert

[11] Patent Number: 4,828,288

[45] Date of Patent: May 9, 1989

[54] DEVICE FOR LINKING SKI TIPS

[76] Inventor: Charles Humbert, P.O. Box 178, 2400 Le Locle, Switzerland

[21] Appl. No.: 118,991

[22] Filed: Nov. 10, 1987

[30] Foreign Application Priority Data

Mar. 17, 1987 [CH] Switzerland ..... 994/874

[51] Int. Cl.[4] ..... A63C 5/06

[52] U.S. Cl. ..... 280/818

[58] Field of Search ..... 280/818, 817, 12 F

[56] References Cited

U.S. PATENT DOCUMENTS

| | | | |
|---|---|---|---|
| 3,357,714 | 12/1967 | Kuehn | 280/818 |
| 3,567,239 | 3/1971 | Kitterman | 280/113.7 |
| 3,992,022 | 11/1976 | Albers | 280/818 |
| 4,453,742 | 6/1984 | Zepkrowksi | 280/818 |

FOREIGN PATENT DOCUMENTS

| | | | |
|---|---|---|---|
| 1945977 | 3/1971 | Fed. Rep. of Germany | 280/818 |
| 2911432 | 10/1980 | Fed. Rep. of Germany | 280/818 |
| 1127678 | 7/1982 | Fed. Rep. of Germany | 280/818 |

*Primary Examiner*—David M. Mitchell

*Attorney, Agent, or Firm*—Pennie & Edmonds

[57] ABSTRACT

The linking device comprises two near-symmetrical portions, each with an attachment piece (1', 1'') which can be fixed securely to the ski tip, an arm (3', 3'') which is integral with the said attachment piece, and a joint (4', 4'') which interconnects the forward ends of the said arms. The joint is preferably of the spherical ball-in-cup type.

The device allows the skis to be positioned parallel to each other, as well as to be turned to the snowplow position, and it renders the sport very much easier for novices.

13 Claims, 2 Drawing Sheets

DEVICE FOR LINKING SKI TIPS

SUMMARY OF THE INVENTION

The invention relates to a device for linking ski tips, allowing the skis to be positioned parallel to each other, as well as to be turned to the snowplow position, the said device comprising an attachment piece for each ski tip, these attachement pieces comprising means of effecting their secure attachment to the ski tips and each comprising an integral arm that is pointed towards the other ski, the free ends of the two arms being united by a joint piece.

The device according to the invention complements a pair of skis. It provides a link between the ski tips, allowing the skis to be positioned parallel to each other, as well as to be turned to the snowplow position.

BACKGROUND OF THE INVENTION

It is well known that guiding the ski tips is a major difficulty for novices in this sport, especially for small children, and there is nowadays a continuous search for simple and satisfactory solutions. The effort that is required of the novice skier in order to assume the snowplow position often imposes an excessive stress, particularly at the knee. Novices typically fall slowly, and these slow falls do not always cause the safety bindings to open.

A device that is intended to make it easier to guide the skis in the parallel position is already known from German patent application No. 2,653,701 and, in particular, from Swiss Pat. No. 641,054. A device of this type comprises a rigid bar which is linked to the front portions of the two skis via its two ends. This linkage is effected with the aid of two separate joints, which are fixed to the tips of the two skis by means of stirrups or screws. In one of the above cases, the joint pieces are designed in a manner such that the end of the link bar disengages under the effect of an excessive force, for example when the skier falls. However, the construction of such devices is relatively complex, and it has been noticed, moreover, that they could hinder certain reactions which are demanded of the skier: in particular, devices of this type do not help the ski edges to grip when in the snowplow position.

THE INVENTION

The device according to the invention, for linking ski tips, has been designed to achieve the object of preserving a number of movements that are fundamental to learning how to ski, in that it allows the skis to be positioned parallel to each other, as well as to be turned to the snowplow position, and in that it comprises an attachment piece for each ski tip, these attachement pieces comprising means of effecting their secure attachment to the ski tips and each comprising an integral arm that is pointed towards the other ski, the free ends of the two arms being united by a joint piece.

The device according to the invention thus prevents the injuries which are sustained following falls that result from the skis becoming crossed, or from their becoming separated by a distance in excess of the limit that the anatomy can tolerate.

BRIEF DESCRIPTION OF THE INVENTION

Figure 1:
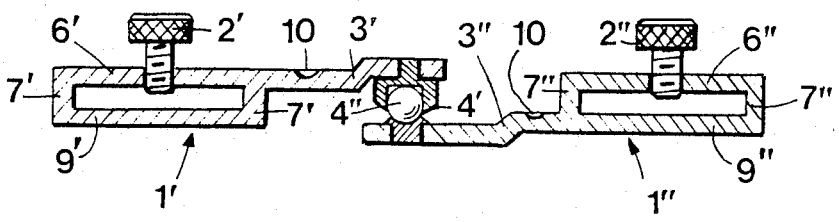
Figure 2:
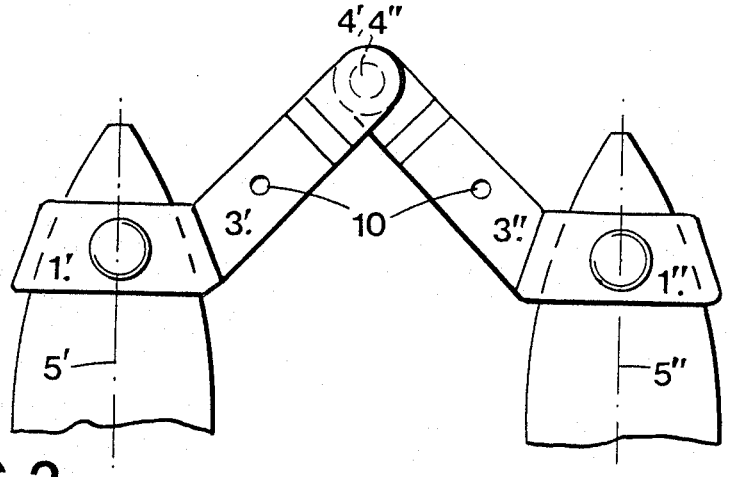
Figure 3:
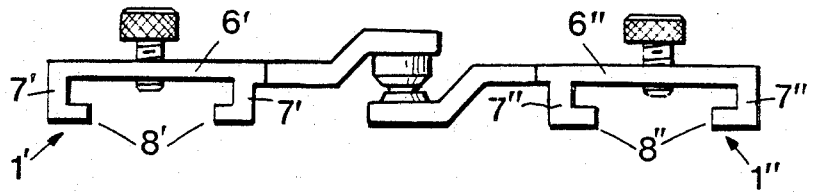
Figure 4:
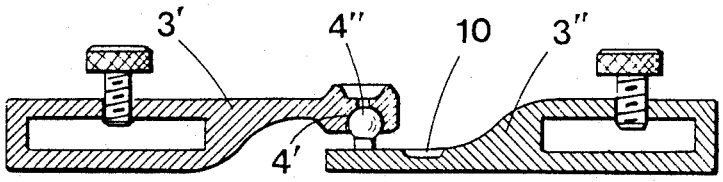

In order to gain a better understanding of the special features and advantages of the invention, embodiments of it are described below, as examples, referring at the same time to the drawings, in which FIG. 1 shows a vertical section through the device according to the invention, FIG. 2 shows a plan view of the same device, FIG. 3 shows a front view of another embodiment of the device, FIG. 4 shows a vertical section through an embodiment that has been manufactured in a different manner, and FIGS. 5, 6 and 7 respectively show a plan view, a section, and an enlarged detail of another embodiment, which allows sideways disengagement.

PREFERRED EMBODIMENTS OF THE INVENTION

FIGS. 1 and 2 show how the device has to be slipped onto the ski tips. It is composed of two near-symmetrical portions, one for the left ski and the other for the right ski, the same elements carrying the same number, with the additional indication ′″″—prime—for the left portion and ″″″—double prime—for the right portion. An attachment piece 1′, 1″ is intended to be fixed to the ski tip, and around the aperture through which the ski tip is intended to be slipped this attachment piece comprises a central piece 6′, 6″, situated above this aperture and exhibiting the same tapered shape as the portion of the ski tip that is snugly fitted therein, and further comprises side members 7′, 7″, the whole arrangement forming a stirrup. In order to retain the ski tip by its undersurface, the embodiment shown in FIG. 1 utilizes a piece 9′, 9″ which is parallel to the central piece 6′, 6″ and closes the stirrup, whereas FIG. 3 shows narrow flanges 8′, 8″ which project inwardly from the portions 7′, 7″. In the Figures, these pieces are shown diagrammatically, but in actual fact they will be given a shape that offers little resistance to the snow, with edges that will be rounded or even steamlined. The attachment piece 1′, 1″ comprises means of effecting its secure attachement to the ski tip, for example a clamping screw 2′, 2″. Experts can of course devise other means of securely attaching the attachment piece to the ski tip, and the choice of these means will depend on whether the device according to the invention will be utilized often or only infrequently. For example, threaded nuts can be incorporated into the ski tip, or else a small plate, with a guide, can be permanently fixed to its upper surface, in which case the attachment piece is secured directly to the said nuts, or slipped into the guide (solutions not shown in the drawings).

An arm 3′, 3″ is integral with the attachment piece 1′, 1″ and extends forwards from it, towards the other ski tip, preferably at an angle of 45° relative to the axes 5′ and 5″ of the skis and attachment pieces 1′, 1″. Each arm terminates in a joint piece 4′, 4″, these two pieces together forming a joint.

In a preferred embodiment, this joint is a spherical ball-in-cup assembly, one joint piece, 4″, being a ball which is fixed, at one side, to the end of an arm 3′, while the other joint piece, 4′, is a concave cup which fits snugly around the ball and can move and rotate on it, through a limited range of movement.

It will now be seen that, even on uneven ground, the device according to the invention maintains the distance between the ski tips, while allowing the skis to be in the parallel position, or in the snowplow or stem-christiania positions.

FIGS. 1 and 4 show two embodiments of the joint: according to FIG. 1, joint pieces are clinch-fitted into the ends of the arms 3', 3'' and thereafter become completely integral with them, while according to FIG. 4 these pieces are moulded integrally with the said arms, forming one-piece components.

The cup of the joint piece is slightly resilient at its edges, so that it can be disengaged from the ball of the joint piece 4'' on which it is engaged. The skier will thus be able to put his skis on one at a time, and when he is ready to move off, the action of pressing the cup onto the ball will enable him to effect engagement and to link his ski tips with the device according to the invention. Small conical indentations 10 enable him to exert the forces needed in order to engage or disengage the joint 4', 4'' with the point of a ski pole. The force required in order to effect disengagement or engagement, as the case may be, has to be exerted perpendicularly to the plane formed by the arms 3' and 3''. In the embodiment that has been described, the center of the joint 4', 4'' is situated in the plane of the central pieces 6', 6''. It is conceivable that other positions of the joint center could offer advantages, depending on the type of downhill run, and on the knowledge possessed by the novice skier. In particular, the center of the joint 4', 4'' can be above or below the plane of the central pieces 6', 6'', while the sweep angle of the arms 3', 3'' can likewise be greater or smaller than 45°, relative to the axes 5' and 5'', and the arms can of course have different lengths for children and adults.

This length can be varied, if required, in the case of a device that is especially designed to be adjustable. In this case, the arm will be made of two elongated pieces, one being securely united with the attachment piece and the other being securely united with the joint piece, and these two elongated pieces will be locked together in a manner such that their total length suits the skier. As the skier progresses, he will be able to adjust the distance between his ski tips (solution not shown in the drawings).

Figure 5:
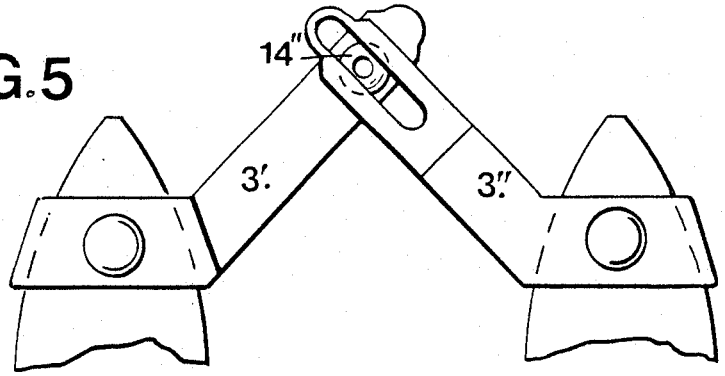
Figure 6:
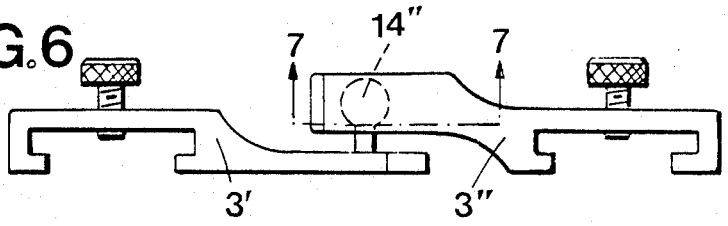
Figure 7:
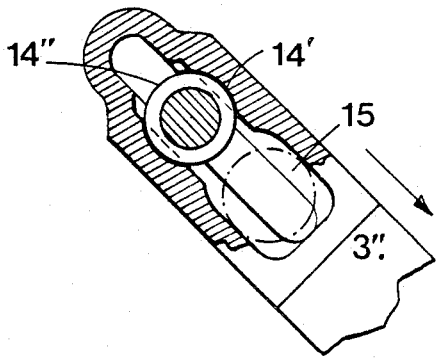

FIGS. 5, 6 and 7 illustrate an embodiment wherein the force for effecting disengagement and engagement is no longer perpendicular to the plane formed by the arms 3' and 3'', but acts within this plane. Under the effect of a force that is directed in a given direction within the plane formed by the arms 3', 3'', the ball 14'', which is normally held captive in its spherical seat 14' in a manner permitting rotation about three mutually perpendicular axes, can disengage itself from the seat 14' by shifting sideways, towards a lateral space 15 that is larger than itself. In the embodiment shown in FIGS. 5, 6 and 7, the force has to be exerted along the axis of the arm 3''. Other arrangements can easily be deviced if it is desired that the direction of the force should, for example, correspond to the axis of the arm 3', or to an intermediate direction, between the axes of the arms 3' and 3''.

What I claim is:

1. A device for linking ski tips, allowing the skis to be positioned parallel to each other, as well as to be turned to the snowplow position, the said device comprising at attachment piece (1',1'') for each ski tip, these attachment pieces comprising means (2',2'') of effecting their secure attachment to the ski tips and each comprising an integral arm (3',3'') that is pointed towards the other ski, the free ends of the two arms being united and limited to rotation at a single point about three mutually perpendicular intersecting axes by means of a joint piece (4,4'').

2. The device as claimed in claim 1, wherein the joint is a spherical ball-in-cup assembly (4', 4'') that allows limited rotation about three mutually perpendicular axes.

3. The device as claimed in claim 1 or 2, wherein the arms (3', 3'') are swept forwards from the attachment pieces (1', 1'') at an angle of approximately 45°, relative to the axis of symmetry (5', 5'') of the attachment pieces.

4. The device as claimed in claims 1 or 2, wherein the attachment piece comprises at least one tapered stirrup (3', 3''), with a central piece (6', 6'') and side members (7', 7'') which can fit snugly on both sides of the ski tip.

5. The device as claimed in claim 4, wherein the side members of the stirrup have projections (8',8'') which are intended to retain the ski tip by its undersurface.

6. The device as claimed in claim 1 or 2, wherein the means of effecting the secure attachment of the attachment piece, to the ski tip, comprise a clamping means (2', 2'').

7. The device as claimed in claim 4, wherein the center of the ball-in-cup assembly is situated in the plane of the central pieces.

8. The device as claimed in claim 4, wherein the center of the ball-in-cup assembly is situated above the plane of the central pieces.

9. The device as claimed in claim 4, wherein the center of the ball-in-cup assembly is situated below the plane of the central pieces.

10. The device as claimed in claim 2, wherein the cup (4') of the joint is resilient at its edges in a manner such that the joint will disengage under the effect of a force that is directed perpendicularly to the plane formed by the arms, and wherein recesses (10) are provided in the arms, allowing the skier to exert this force with the point of a ski pole.

11. The device as claimed in claim 2, wherein the cup of the joint is resilient at its edges in a manner such that the joint will disengage under the effect of a force that is directed in a given direction within the plane formed by the arms (3',3'').

12. The device as claimed in claim 4 wherein said side members are joined by a piece (9',9'') which is parallel to the central piece (6',6'') of the stirrup.

13. A device for linking ski tips, allowing the skis to be positioned parallel to each other, as well as to be turned to the snowplow position, said device comprising attachment pieces (1',1'') for each ski tip, the attachment pieces comprising means (2',2'') for effecting their secure attachment to the ski tips and each comprising an integral arm (3',3'') that is pointed towards the other ski, the free ends of the two arms being united and limited to rotation about three mutually perpendicular axes by means of a joint piece (4',4''), wherein the joint is a spherical ball-in-cup assembly, and wherein the cup (4') of the joint is restricted at its edges in a manner such that the joint will disengage under the effect of a force that is directed perpendicularly to the plane formed by the arms, and wherein recesses (10) are provided in the arms, allowing the skier to exert this force with the point of a ski pole.

* * * * *